US005646382A

United States Patent [19]

Moriya

[11] Patent Number: 5,646,382

[45] Date of Patent: Jul. 8, 1997

[54] MULTIPLE PUSH BUTTON SWITCH ASSEMBLY WITH MULTISTAGE ACTUATOR INTERLOCK

[75] Inventor: Toshio Moriya, Mitaka, Japan

[73] Assignee: Kasuga Denki Kabushiki Kaisha, Tokyo, Japan

[21] Appl. No.: 511,753

[22] Filed: Aug. 7, 1995

[30] Foreign Application Priority Data

Aug. 18, 1994 [JP] Japan ..... 6-216680

[51] Int. Cl.[6] ..... H01H 9/26; H01H 13/02

[52] U.S. Cl. ..... 200/50.33; 200/5 E; 200/50.36

[58] Field of Search ..... 200/5 R–5 EB, 200/50 C, 50.32, 50.33, 50.36, 50.37, 50.4, 293–307, 5 A, 5 B, 5 C, 5 D, 5 E, 5 EA, 50.31, 50.34, 50.35, 50.38, 50.39

[56] References Cited

U.S. PATENT DOCUMENTS

| | | | |
|---|---|---|---|
| 2,713,092 | 7/1955 | Rucks et al. | 200/50.36 X |
| 4,356,363 | 10/1982 | Harbauer et al. | 200/50.33 |
| 4,427,853 | 1/1984 | Layciak et al. | 200/50.36 |
| 4,539,860 | 9/1985 | Johnston et al. | 200/50.36 X |
| 4,713,498 | 12/1987 | Ludwig et al. | 200/5 R |
| 4,724,287 | 2/1988 | Heng et al. | 200/14 |
| 4,851,620 | 7/1989 | Schaeffer | 200/307 X |
| 4,861,949 | 8/1989 | Bortolloni et al. | 200/5 R |
| 4,883,927 | 11/1989 | Apfelbacher et al. | 200/50.33 |
| 5,045,647 | 9/1991 | Kato | 200/50.36 X |

FOREIGN PATENT DOCUMENTS

| | | | |
|---|---|---|---|
| 4-31686Y2 | 7/1992 | Japan | H01H 9/20 |

*Primary Examiner*—J. R. Scott

*Attorney, Agent, or Firm*—Watson Cole Stevens David P.L.L.C.

[57] ABSTRACT

A push button switch provided with a multistage actuation interlock function is composed of a casing; a pair of push buttons arranged side by side passing through an upper lid of the casing; a plurality of movable bodies arranged movably in a direction perpendicular to a depression direction of the push buttons into the casing; a plurality of movable contacts attached to the movable bodies, respectively; and a plurality of fixed contacts arranged on a base portion of the casing in confronting positional relationship with respect to the movable contacts. When each of the push buttons is depressed at each of the multistage stroke, the movable body is shifted to bring the movable contact into contact with the fixed contact, respectively in sequence. Further, an interlock plate is interposed between and associated with the two push buttons in the casing.

4 Claims, 8 Drawing Sheets

MULTIPLE PUSH BUTTON SWITCH ASSEMBLY WITH MULTISTAGE ACTUATOR INTERLOCK

BACKGROUND OF THE INVENTION

1. Field of the Invention

The present invention relates to a push button switch provided with a multistage actuation interlock function for actuating a plurality of switches at multiple stages, which is suitable for use to control a motor for driving a hoist, a chain block, etc. at a plurality of stages of speed.

2. Description of the Prior Art

The push button switch provided with a two-stage actuation interlock function used for reversibly rotating a motor for driving a hoist, a chain block, etc. has been already disclosed in JP-Y-4-31686. The prior art push button switch as described above is provided with an interlock plate pivotally supported by a fixed axle, and a pair of movable bodies for actuating each of both ends of the interlock plate. An upper end of each of the movable bodies projects out of a casing so as to function as a push button. Each of the movable bodies is formed with a recessed portion on both side portions thereof, respectively. Further, a lid body is formed with a stepped portion in correspondence to the recessed portion, respectively. Further, a mutually-operative bearing and spring assembly is provided at the corresponding recessed portion and the stepped portion, respectively. Since the prior art push button switch is constructed as described above, it is possible to realize a push button switch provided with a two-stage switching function.

Here, when a three-stage push button switch is required to be constructed on the basis of the structure which is basically the same as the above-mentioned prior art push button switch provided with the two-stage actuated interlock plate, the size of the push button switch inevitably increases, as shown in FIGS. 1(A) to 1(D).

In more detail, with reference to FIGS. 1(A) to 1(D), an internal space of a casing 1 is divided symmetrically into right and left sides, and an interlock plate 16 is pivotally provided so as to be pivotal about a fixed axle 17 mounted horizontally at the middle bottom portion of the casing 1. A pair of push buttons 20*a* and 20*b* movable in the vertical direction are arranged so as to project out of the upper portion of the casing 1. Under the lower end of each of the push buttons 20*a* and 20*b*, a movable body 21*a* or 21*b* is attached, respectively. Whenever the push button 20*a* or 20*b* is actuated, the interlock plate 16 is pivoted by being pushed by the movable body 21*a* or 21*b*. Each of the movable bodies 21*a* and 21*b* has one set of three movable contacts 18*a*, 18*b* and 18*c*, respectively. On the other hand, on the bottom surface of the casing, one set of three fixed contacts 19*a*, 19*b* and 19*c* are provided so as to be opposed to the three movable contacts 18*a*, 18*b* and 18*c*, respectively. Therefore, whenever the push button 20*a* or 20*b* is depressed, these three movable contacts 18*a*, 18*b* and 18*c* are closed (turned on) so as to contact the fixed contacts 19*a*, 19*b* and 19*c* selectively in sequence according to the stroke of the push button 20*a* or 20*b*. Here, a pair comprising the movable contact 18*a* and the fixed contact 19*a* constitutes the first stage contacts; a pair comprising the movable contact 18*b* and the fixed contact 19*b* constitutes the second stage contacts; and a pair comprising the movable contact 18*c* and the fixed contact 19*c* constitutes the third stage contacts. Movable contacts 18*a* to 18*c* are provided with a contact spring 22 (shown in FIG. 1(A)), respectively, to obtain a predetermined respective contact pressure.

FIG. 1(A) shows the state where the two push buttons 20*a* and 20*b* are both not depressed so that the push button switch is completely turned off. FIG. 1(B) shows the state where the first button 20*a* is depressed so that the pair comprising the first-stage movable contact 18*a* and the fixed contact 19*a* are in contact with each other. FIG. 1(C) shows the state where the first button 20*a* is further depressed deeper so that the pair comprising the second-stage movable contact 18*b* and the fixed contact 19*b* are in contact with each other in addition to the first-stage movable and fixed contacts 18*a* and 19*a*. FIG. 1(D) shows the state where the first push button 2*a* is furthermore depressed deeper so that the pair comprising the third-stage movable contact 18*c* and the fixed contact 19*c* are in contact with each other in addition to the first- and second-stage movable and fixed contacts 18*a*, 18*b* and 19*a*, 19*b* (all pairs of the movable and fixed contacts are in contact with each other only on the side of the push button 20*a*).

As is well-understood with reference to FIGS. 1(A) to (D), when the third-stage contact pairs are required to be closed to each other completely, since the push button 20*a* must be depressed deeply in the downward direction, the interlock plate 16 is inevitably pivoted clockwise through a large angle by the movable body 21*a*, with the result that there exists a problem in that the size of the entire push button switch inevitably increases.

SUMMARY OF THE INVENTION

With these problems in mind, therefore, it is the object of the present invention to provide a push button switch provided with a multistage actuation interlock function, by which the contacts can be closed at multiple stages without increasing the stroke of the push buttons and the size of the interlock plate.

To achieve the above-mentioned object, the present invention provides a push button switch provided with a multistage actuation interlock function, which comprises: a casing; a pair of push buttons arranged side by side passing through an upper lid of said casing; a plurality of movable bodies arranged movably in a direction perpendicular to a depression direction of said push buttons into said casing; a plurality of movable contacts attached to said movable bodies, respectively; a plurality of fixed contacts arranged on a base portion of said casing in confronting positional relationship with respect to said movable contacts, wherein whenever each of said push buttons is depressed at multistage strokes, each of said movable body is shifted to bring each of said movable contacts into contact with each of said fixed contacts, respectively in sequence; and an interlock mechanism interposed between and associated with a pair of said push buttons within said casing.

That is, to achieve the above-mentioned object, in the push button switch provided with a multistage actuation interlock function according to the present invention, two return springs are provided on both sides of the lower portion of a groove formed by two middle thin-walls of the base portion of the casing body; two push buttons are each formed with a stepped portion each having a projection on both sides thereof respectively, with three downwardly sloped portions extending perpendicular to the stepped portion (one on one side thereof and two on the other side thereof), an engaging portion also perpendicular to the stepped portion on one side thereof, and a straight portion also perpendicular to the stepped portion on the other side thereof. The two push buttons are provided on the two return springs, respectively. A triangular cross section projection is formed at the middle base portion of the middle thin-walled groove of the base portion of the casing body. Further, an interlock plate is formed with a lower convex projection, with two upper right and left axle portions extending in two opposite directions, respectively at both upper right and left sides thereof, and with two cutout portions. The axle portions of the interlock plate are engaged with the engaging portions of the push buttons, respectively. A plurality of movable bodies movable in the direction perpendicular to the actuation direction of the push buttons are arranged in the base horizontal direction of the casing; and further the fixed contacts brought into contact with the movable contacts of the movable bodies are arranged also in the base horizontal direction of the casing.

In the push button switch according to the present invention, it is possible to construct the push button switch provided with a multistage actuation interlock function, without increasing the size of the interlock or the stroke of the push buttons. In this case, since the two movable bodies located at the middle portion of the casing and between the two push buttons are constructed by a single structure and further since the movable contacts and the fixed contacts are arranged in a direction perpendicular to the actuation direction of the push buttons into the casing, it is possible to simplify the connection between the contacts by use of connection plates when the electrical interlock function is required, thus simplifying the wiring work markedly.

The push button switch provided with the multistage actuation interlock function of this type is usually used as a pendant switch. In this case, the prior art push button switch is often actuated erroneously due to an external shock applied along the push button actuation direction from an external structure. In the push button switch according to the present invention, however, since the contacts are arranged in the direction perpendicular to the actuation direction of the push buttons, it is possible to effectively prevent the push button switch from being actuated erroneously by an external shock.

DETAILED DESCRIPTION OF THE EMBODIMENTS

The push button switch provided with a multistage actuation interlock function according to the present invention will be described in detail hereinbelow with reference to the attached drawings, on the basis of an embodiment of a three-stage actuated push button switch, by way of example.

Figure 1A:
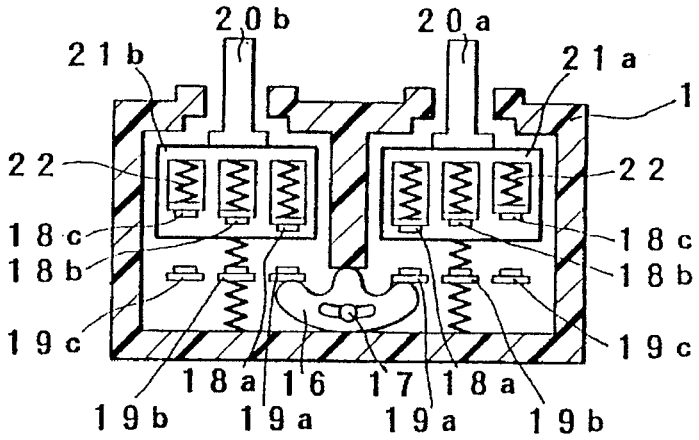
FIG. 1A PRIOR ART
FIGS. 1(A) to 1(D) are cross-sectional views showing the internal arrangements of the prior art push button switch provided with a multistage actuation interlock function, in which the open-closed conditions of the switches are shown at each of the multiple stages.
Figure 1B:
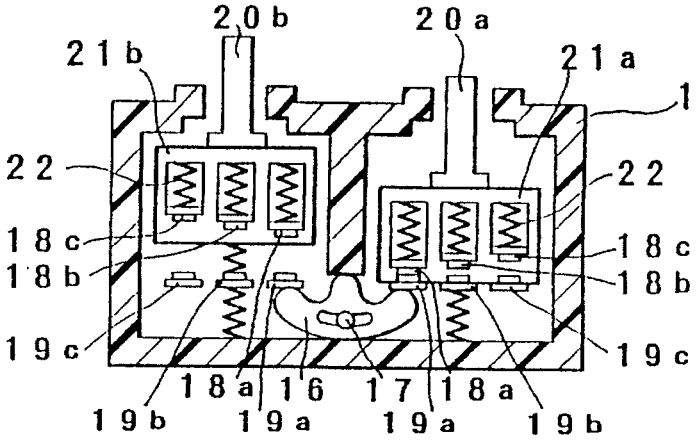
FIG. 1B PRIOR ART
Figure 1C:
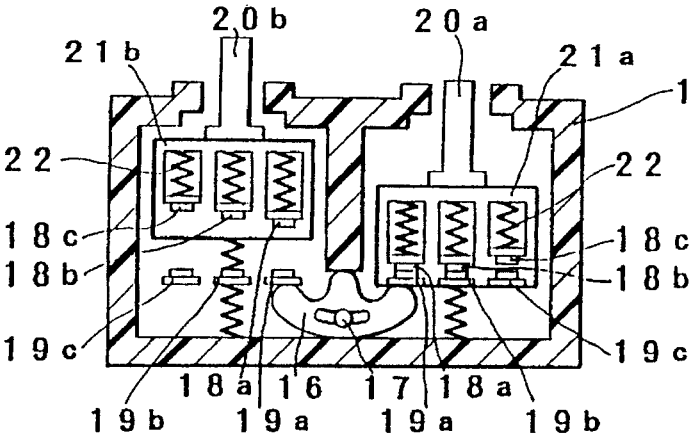
FIG. 1C PRIOR ART
Figure 1D:
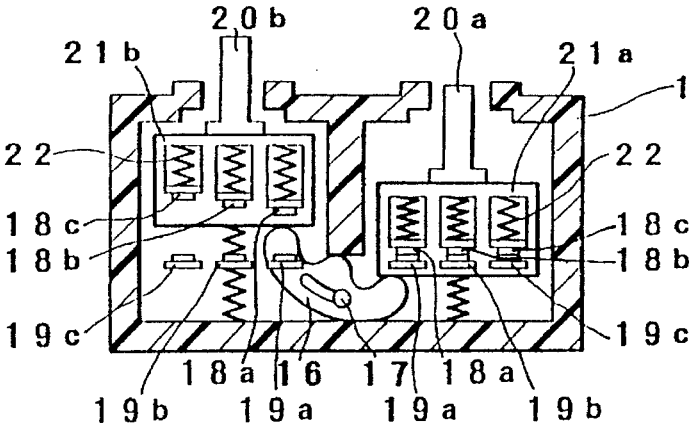
FIG. 1D PRIOR ART
Figure 2:
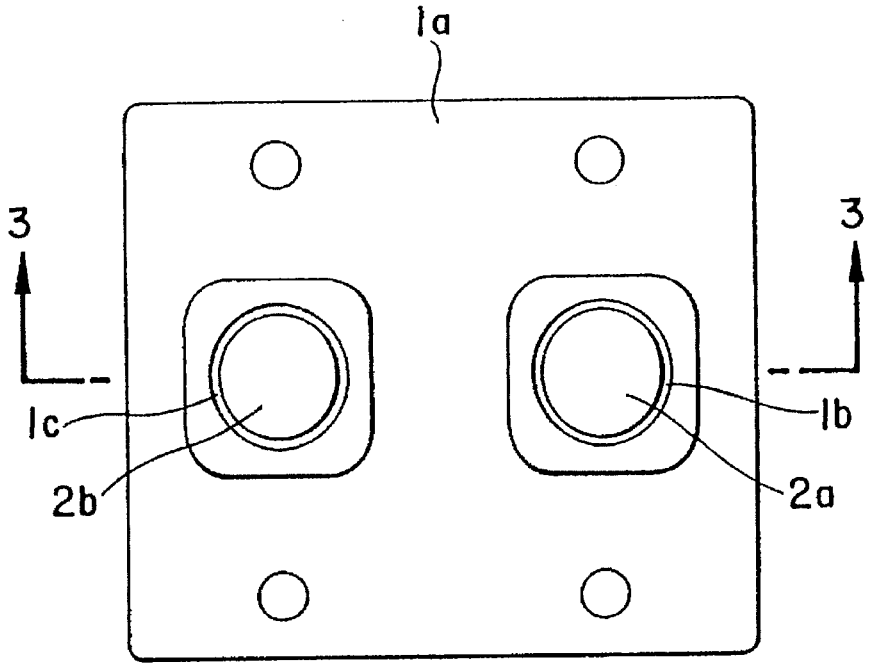
FIG. 2 is a front view showing an embodiment of the push button switch provided with a multistage actuation interlock function according to the present invention.
Figure 5:
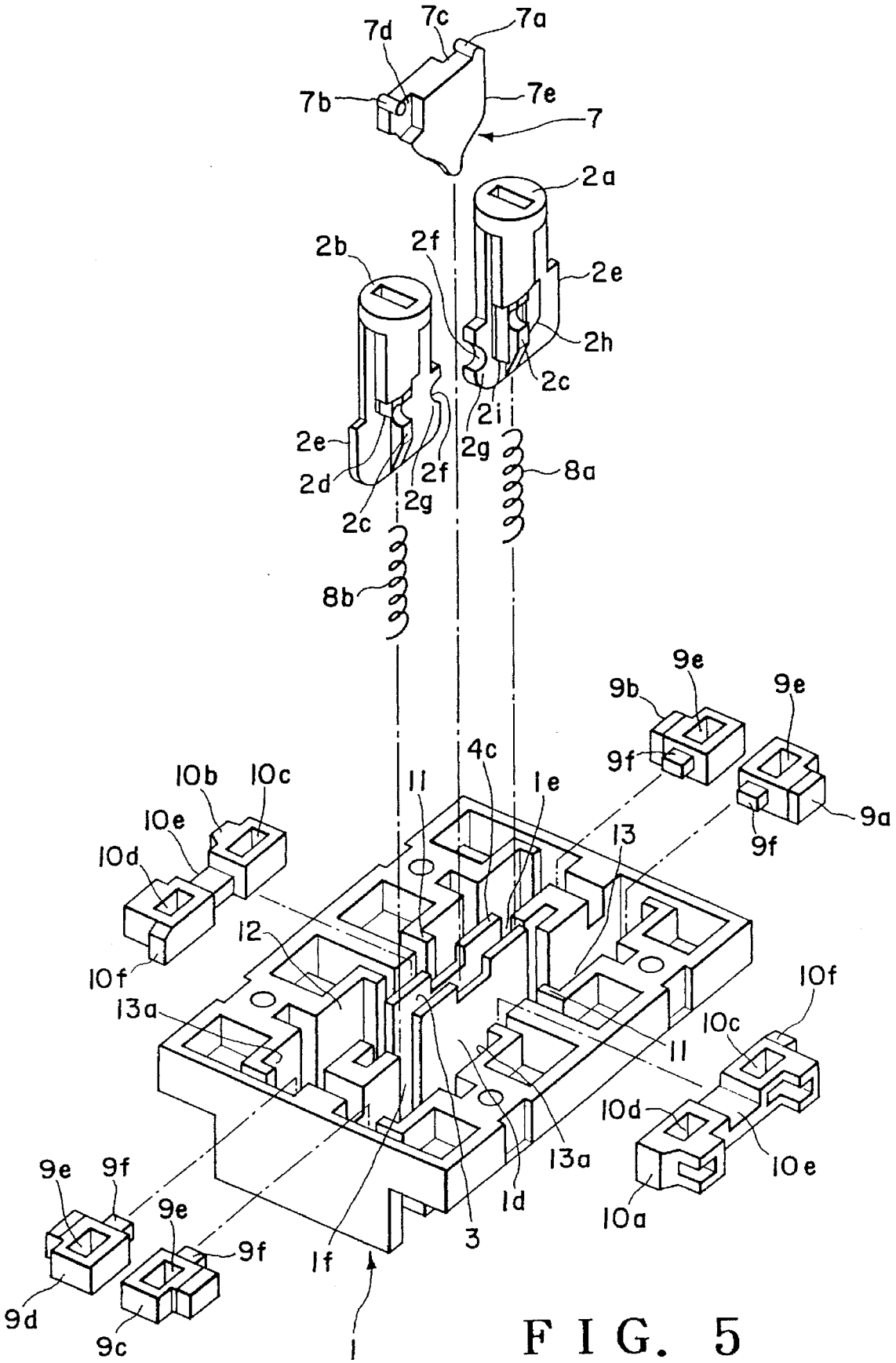
FIG. 5 is an exploded view showing the push button switch according to the present invention.
Figure 7:
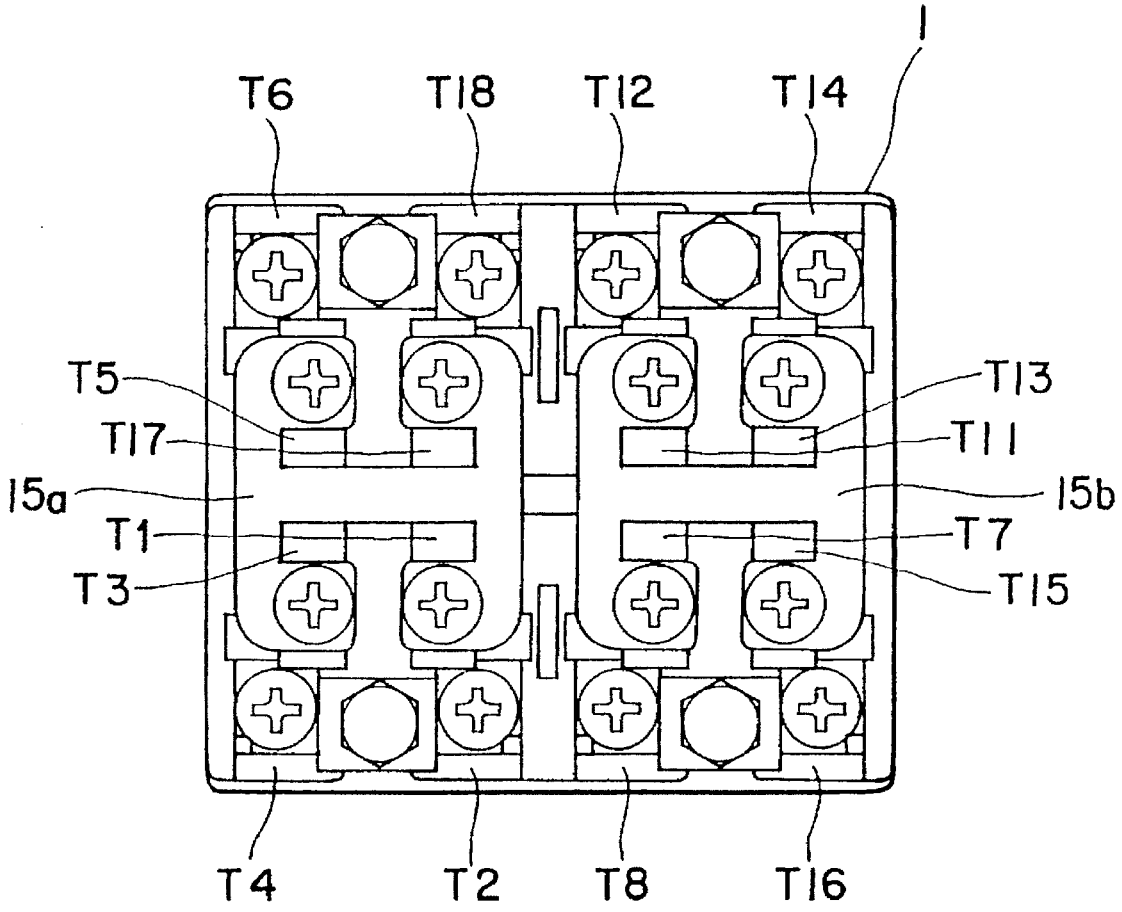
FIG. 7 is a back view showing the push button switch according to the present invention.

With reference to FIGS. 2 and 7, two push buttons 2*a* and 2*b* are provided within a casing 1 so as to pass through two holes 1*b* and 1*c* formed on a lid la of the casing 1. Two return springs 8*a* and 8*b* are arranged between the two push buttons 2*a* and 2*b* and the bottom surface of the casing 1. Further, as shown in FIG. 5, each of the two push buttons 2*a* and 2*b* is formed with a stepped portion 2*c* on two opposing side surfaces thereof, respectively, to locate the multistage (three stage) positions of the push button 2*a* or 2*b*. Further, each of the push buttons 2*a* and 2*b* is formed with three downward sloping portions of different lengths (a long sloping portion 2*i*, a middle sloping portion 2*h*, and a short sloping portion 2*d*), respectively, on both opposing side surfaces thereof perpendicular to the stepped portions 2*c*. In FIG. 5, the short sloping portion 2*d* of the push button 2*a* and the long and middle sloping portions 2*i* and 2*h* of the push button 2*b* are both not visible in the perspective view of FIG. 5. The downward slopping portions 2*d*, 2*h* and 2*i* are used to slide (move) a plurality of movable bodies 9*a* to 9*d* and 10*a* and 10*b* in the horizontal direction, as described below in detail. Further, each of the push buttons 2*a* and 2*b* is formed with a vertical straight portion 2*e* on one of the two opposing side surfaces thereof and an engaging portion 2*g* (having a semicircular recessed portion 2*f*) on the other of the two opposing side surfaces thereof, both perpendicular to the stepped portions 2*d*.

As shown in FIG. 5, various parts are all arranged within the casing 1. The casing 1 has a middle wall 1*d* substantially composed of two thin-walled plates so as to form a thin groove portion 3 therebetween in such a direction as to extend along the middle portion of the casing 1 in the longitudinal direction of the casing 1 (the right and left direction in FIG. 2 or FIG. 5). The wall 1*d* is cut away so as to form the right and left gaps 1*e* and 1*f* symmetrically. Further, as shown in FIG. 3, a triangular cross-sectional projection 5 is formed on the inner bottom surface of the casing 1 so as to cross the groove portion 3 (perpendicular to the wall 1*d*).

Figure 3:
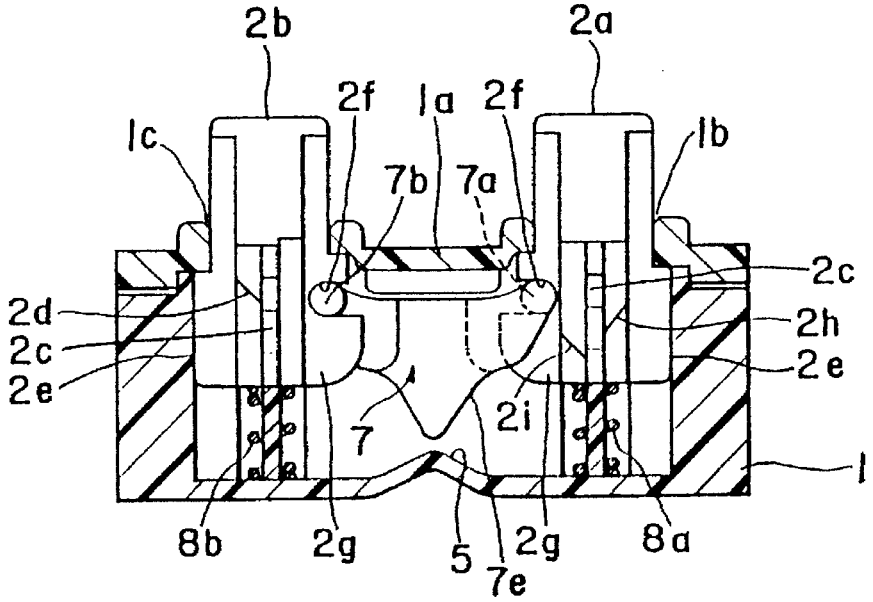
FIG. 3 is a cross-sectional view taken along the line 3—3 in FIG. 2.

With reference to FIGS. 3 and 5, the relationship between the push buttons 2*a* and 2*b*, the interlock plate 7, and the casing 1 will be explained hereinbelow. The two return springs 8*a* and 8*b* are disposed in the two gaps 1*e* and 1*f* of the wall 1*d*. The two push buttons 2*a* and 2*b* are mounted on the return springs 8*a* and 8*b*, respectively, such that the vertical straight portions 2*e* of the push buttons 2*a* and 2*b* can be slid in the wall 1*d* (between the two thin-walled plates of the wall 1*d*). Further, the interlock plate 7 is formed with two axle portions 7*a* and 7*b* extending in two opposite directions, respectively, along the lateral direction of the casing 1 (the upper and lower direction in FIG. 2), respectively on both the upper right and left sides thereof. Further, the interlock plate 7 is formed with two cutout portions 7*c* and 7*d* on the projection sides of the axle portions 7*a* and 7*b*, respectively. Further, a convex curved portion 7*e* is formed at the lower end of the interlock plate 7 symmetrically. Here, as shown in FIG. 3, the two axle portions 7*a* and 7*b* formed in the interlock plate 7 are engaged with the two semicircular portions 2*f* formed in the engage portions 2*g* of the two push buttons 2*a* and 2*b*, respectively. Here, since the axial length of the two axle portions 7*a* and 7*b* are roughly equal to the depth of the cutout portions 7*c* and 7*d* formed in the interlock plate 7, even if the push buttons 2*a* and 2*b* are engaged with the interlock plate 7, the interlock plate 7 can be movable within the groove 3 of the wall 1*d*. Therefore, when the push buttons 2*a* and 2*b* are depressed from the outside, the push buttons 2*a* and 2*b* can be moved up and down through the two holes 1*b* and 1*c* formed in the lid 1*a* of the casing 1 and guided along the two thin-walled plates of the wall 1*d*, respectively. With reference to FIG. 5, the four small movable bodies 9*a*, 9*b*, 9*c* and 9*d* are arranged on the outer side of the casing 1. Each small movable body 9 is formed with a window 9*e* for accommodating a movable contact and with a triangular upward sloping portion 9*f* (when brought into contact with the downward sloping portion of the push button, moved in the horizontal direction). On the other hand, the two large movable bodies 10*a* and 10*b* are arranged on the inner side of the casing 1. Each large movable body 10 is formed with two windows 10*c* and 10*d* for accommodating two movable contacts, respectively, with a middle recessed portion 10*e* between the two windows 10*c* and 10*d*, and with a triangular upward sloping portion 10*f* (when brought into contact with the downward sloping portion of the push button, moved in the horizontal direction).

FIG. 5 shows the assembly positions of the two push buttons 2*a* and 2*b*, the interlock plate 7, the two return springs 8*a* and 8*b*, the four small movable bodies 9*a* to 9*d*, and the two large movable bodies 10*a* and 10*b* in the casing 1.

Figure 4:
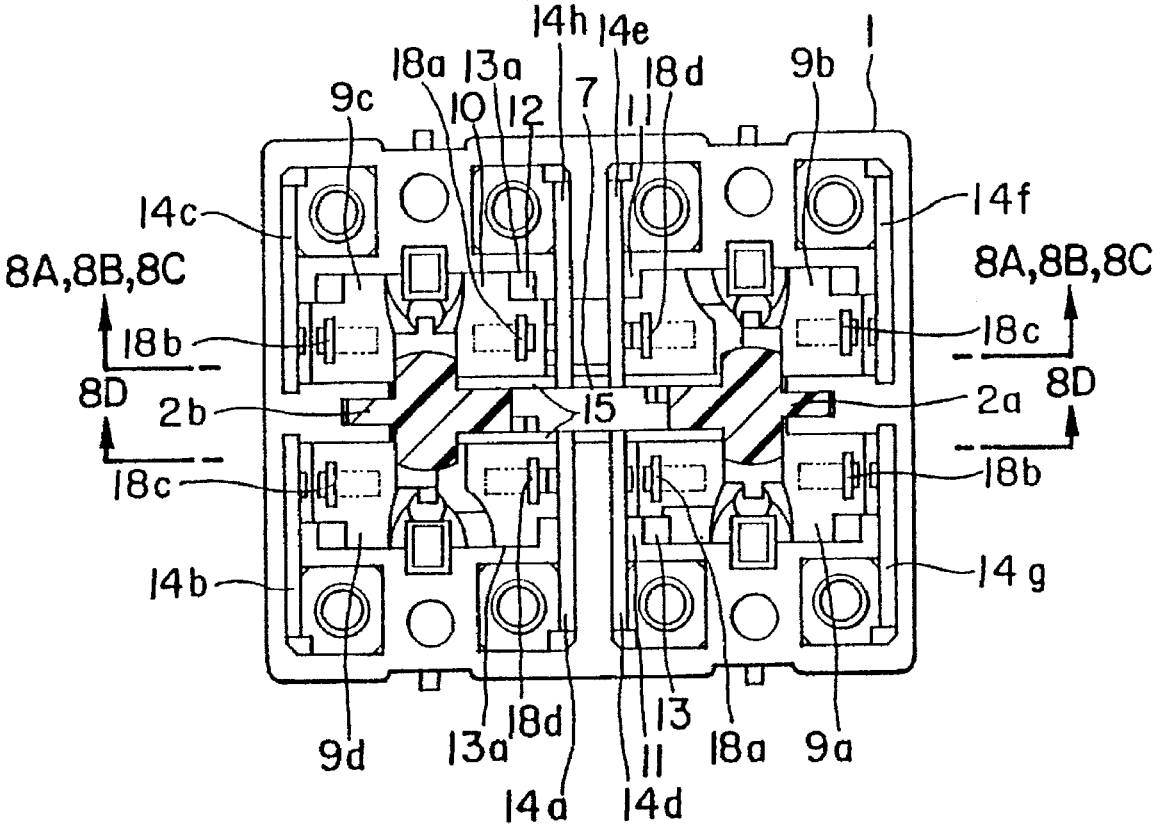
FIG. 4 is a front view showing the push button switch according to the present invention, in which the casing is removed.

With reference to FIGS. 4 and 5, the two push buttons 2*a* and 2*b* are engaged with the interlock plate 7 by engaging the two axle portions 7*a* and 7*b* of the interlock plate 7 with the engaging portions 2*g* of the two push buttons 2*a* and 2*b*, and then inserted into the groove portion 3 of the wall 1*d* vertically standing within the casing 1 (as shown in FIG. 3).

As shown in FIG. 5, within the casing 1, two spaces 12 and 13 are formed on both sides of the wall 1*d* between one surface of the wall 1*d* and an inner casing wall 13*a* in such a way as to be opposed to each other. Further, a projected portion 11 is formed between the two spaces 12 and 13 on each side of the inner casing wall 13*a* (so as to face the wall 1*d*). Therefore, the recessed portion 10*e* of each of the two large movable bodies 10*a* and 10*b* is engaged with the projected portion 11, respectively, such that the triangular upward sloping portion 10*f* of the large movable body 10*a* can be located on the right side in FIG. 5 and the triangular upward sloping portion 10*f* of the large movable body 10*b* can be located on the left side in FIG. 5.

Further, the four small movable bodies 9*a*, 9*b*, 9*c* and 9*d* are arranged in the four spaces 12 and 13 of the casing 1, respectively, as shown in FIG. 5, such that the upward sloping portion 9*f* of each of these movable bodies 5 is directed inward. Here, as shown in FIG. 4, the two small movable bodies 9*a* and 9*c* are provided with a movable contact 18*b*, respectively, and the two small movable bodies 9*b* and 9*d* are provided with a movable contact 18*c*, respectively. These movable contacts 18*b* and 18*c* are all attached to the four movable bodies 9*a* to 9*e*, respectively, so as to be directed outwardly of the casing 1 horizontally and to confront a fixed contact, respectively.

In more detail, with reference to FIG. 4, the movable contact 18*b* of the movable body 9*a* can be brought into contact with a fixed contact fixed to a terminal plate 14*g* when the movable body 9*a* is moved rightward by the push button 2*a*. The movable contact 18*c* of the movable body 9*b* can be brought into contact with a fixed contact fixed to a terminal plate 14*f* when the movable body 9*b* is moved rightward by the push button 2*a*. The movable contact 18*b* of the movable body 9*c* can be brought into contact with a fixed contact fixed to a terminal plate 14*c* when the movable body 9*c* is moved leftward by the push button 2*b*. The movable contact 18*c* of the movable body 9*d* can be brought into contact with a fixed contact fixed to a terminal plate 14*b* when the movable body 9*d* is moved leftward by the push button 2*b*. Each of these terminal plates 14*b*, 14*c*, 14*f* and 14*g* are all formed into an L-shape and has a terminal portion (connected to an external load through a lead) at each end thereof, respectively.

On the other hand, the two large movable bodies 10*a* and 10*b* are arranged in the two spaces each formed between the spaces 12 and 13 of the casing 1, respectively, as shown in FIG. 5, such that the upward sloping portion 10*f* of each of the movable bodies 10*a* and 10*b* are directed outward of the casing 1. Here, each of the two large movable bodies 10*a* and 10*b* is provided with two movable contacts 18*a* and 18*d*, respectively, as shown in FIG. 4. The movable contacts 18*a* and 18*d* are all attached to the two large movable bodies 10*a* to 10*b*, respectively, so as to be directed horizontally inward of the casing 1 and to confront a fixed contact, respectively.

In more detail, with reference to FIG. 4, the movable contact 18*a* of the movable body 10*a* can be brought into contact with a fixed contact fixed to a terminal plate 14*d* when the movable body 10*a* is moved leftward by the push button 2*a*. The movable contact 18*d* of the movable body 10*a* is in contact with a fixed contact fixed to a terminal plate 14*a* even if the movable body 10*a* is not moved by the push button 2*a*. The movable contact 18*a* of the movable body 10*b* can be brought into contact with a fixed contact fixed to a terminal plate 14*h* when the movable body 10*b* is moved rightward by the push button 2*b*. The movable contact 18*d* of the movable body 10*b* is in contact with a fixed contact fixed to a terminal plate 14*e* even if the movable body 10*b* is not moved by the push button 2*a*. Each of these terminal plates 14*a*, 14*d*, 14*e* and 14*h* is formed into an L-shape and has a terminal portion (connected to an external load through a lead) at each end thereof, respectively.

Therefore, when the two push buttons 2*a* and 2*b* are both not depressed, the eight switches are positioned as shown in FIG. 4, in which it should be noted that the two movable contacts 18*d* of the movable bodies 10*a* and 10*b* are both normally-closed contacts, respectively, and the other remaining movable contacts are all normally-open contacts.

Therefore, when the push button 2*a* is depressed at a first stroke, the long downward sloping portion 2*i* of the push button 2*a* (projecting from the gap 1*e*) is brought into contact with the upward sloping portion 10*f* of the large movable body 10*a* (moved leftward) to close the contacts 18*a* and 19*a* and open the interlock contacts 18*d* and 19*d* thereof. When depressed at a second stroke, the middle downward sloping portion 2*h* of the push button 2*a* is brought into contact with the upward sloping portion 9*f* of the small movable body 9*a* (moved rightward) to close the contact 18*b* and 19*b* thereof. When depressed at a third stroke, the short downward sloping portion 2*d* of the push button 2*a* is brought into contact with the upward sloping portion 9*f* of the small movable body 9*b* (moved rightward) to close the contacts 18*c* and 19*c* thereof. Under these conditions, the interlock contacts 18*d* and 19*d* of the large movable body 10*b* are kept closed.

In the same way, when the push button 2*b* is depressed at a first stroke, the long downward sloping portion 2*i* of the push button 2*b* (projecting from the gap 1*f*) is brought into contact with the upward sloping portion 10*f* of the large movable body 10*b* (moved rightward) to close the contacts 18*a* and 19*a* and open the interlock contacts 18*d* and 19*d* thereof. When depressed at a second stroke, the middle downward sloping portion 2*h* of the push button 2*b* is brought into contact with the upward sloping portion 9*f* of the small movable body 9*c* (moved leftward) to close the contact 18*b* and 19*b* thereof; and when depressed at a third stroke, the short downward sloping portion 2*d* of the push button 2*b* is brought into contact with the upward sloping portion 9*f* of the small movable body 9*d* (moved leftward) to close the contacts 18*c* and 19*c* thereof. Under these conditions, the interlock contacts 18*d* and 19*d* of the large movable body 10*a* are kept closed.

In the above-mentioned construction of the push button switch provided with the multistage actuation interlock function according to the present invention, since the interlock plate 7 formed with two right and left symmetrical axle portions 7*a* and 7*b* engaged with the two engaging portions 2*g* of the push buttons 2*a* and 2*b* supported in an upward direction by the two return springs 8*a* and 8*b* (without supporting the interlock plate by the two upper and lower return springs as with the case of the prior art), it is possible to minimize the size of the interlock mechanism. In addition, since the movable bodies having the movable contacts are moved in the horizontal direction (without moving in the vertical direction as with the case of the prior art), it is possible to further reduce the entire size of the push button switch.

Figure 6:
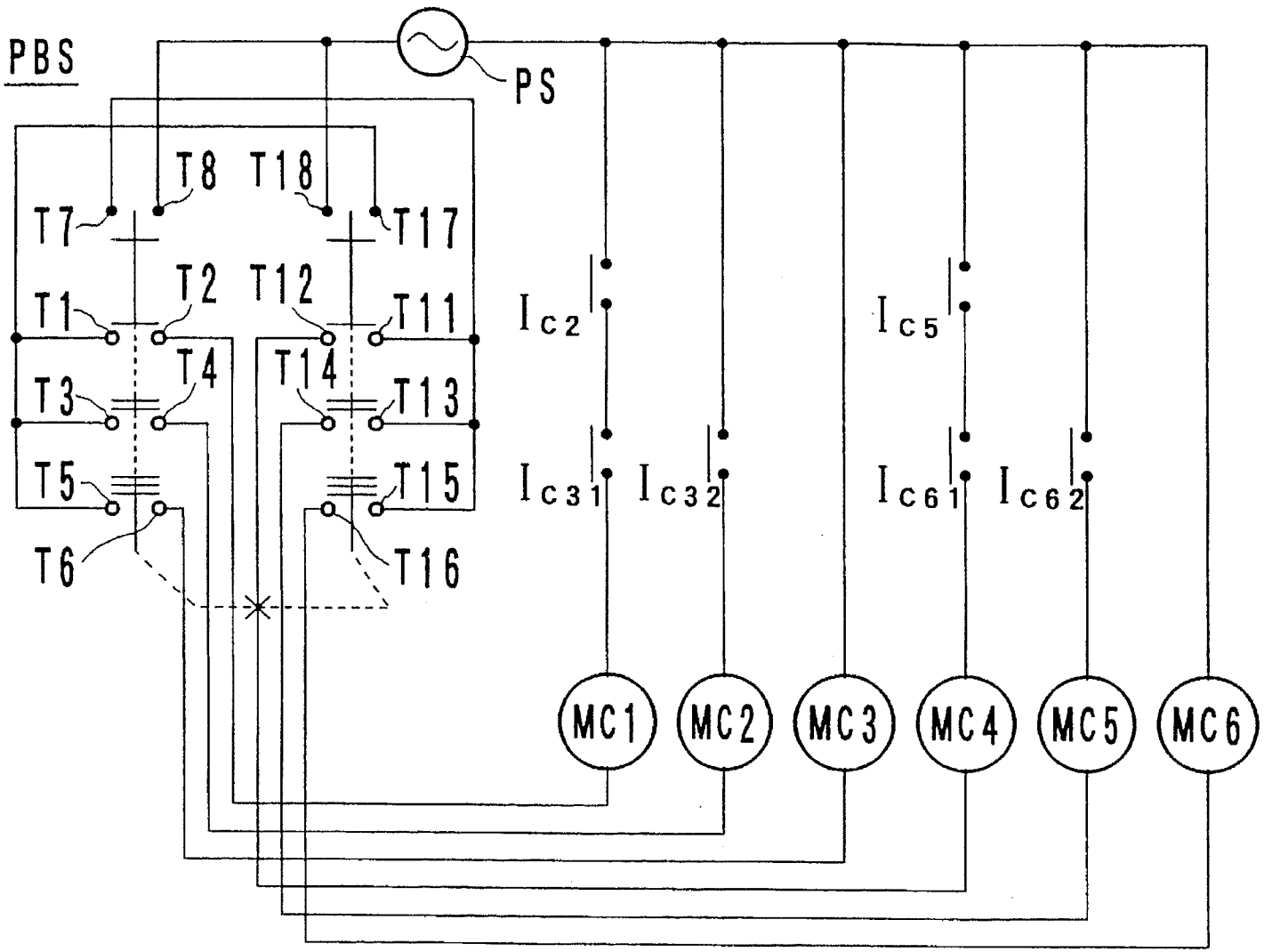
FIG. 6 is a wiring diagram showing an example of the application of use of the contacts of the push button switch according to the present invention.

FIG. 6 shows an external wiring diagram showing an example of the application of the contact outputs of the push button switch PBS according to the present invention.

By use of the push button PBS, the following six magnetic contacts MC can be selectively energized: a first magnetic contact MC1 (the first stage speed in the normal direction), a second magnetic contact MC2 (the second stage speed in the normal direction), a third magnetic contact MC3 (the third stage speed in the normal direction), a fourth magnetic contact MC4 (the first stage speed in the reverse direction), a fifth magnetic contact MC5 (the second stage speed in the reverse direction), and a sixth magnetic contact MC6 (the third stage speed in the reverse direction).

The electrical interlock function can be realized on the basis of the normally-closed contacts in the reversible operation, for instance as follows: when the first stage speed normal direction push button is depressed, since the normally-open contacts T1–T2 on the normal direction side are turned on, the first contact MC1 can be energized by way of a power source PS, the normally-closed contacts T17–T18 on the reverse direction side, the normally-open contacts T1–T2 (now closed) on the normal direction side, the normally-closed contact Ic31 of the third stage speed normal direction contact MC3, and the normally-closed contact Ic2 of the second stage speed normal direction contact MC2. In the same way, when the second stage speed normal direction push button is depressed, since the normal-open contacts T3–T4 on the normal direction side are turned on, the second contact MC2 can be energized by way of the power source PS, the normally-closed contacts T17–T18 on the reverse side, the normal-open contacts T3–T4 (now closed) on the normal direction side, and the normally-closed contact Ic32 of the third stage speed normal direction contact MC3. In the same way, when the third stage speed normal direction push button is depressed, since the normal-open contacts T5–T6 on the normal direction side are turned on, the third contact MC3 can be energized by way of the power source PS, the normally-closed contacts T17–T1B on the reverse direction side, and the normally-open contacts T5–T6 (now closed) on the normal direction side.

Further, when the first stage speed reverse direction push button is depressed, since the normally-open contacts T11–T12 on the reverse direction side are turned on, the fourth contact MC4 can be energized by way of a power source PS, the normally-closed contacts T7–T8 on the normal direction side, the normal-open contacts T11–T12 (now closed) on the reverse direction side, the normally-closed contact Ic61 of the third stage speed reverse direction contact MC6, and the normally-closed contact Ic5 of the second stage speed reverse direction contact MC5. In the same way, when the second stage speed reverse direction push button is depressed, since the normally-open contacts T13–T14 on the reverse direction side are turned on, the fifth contact MC5 can be energized by way of the power source PS, the normally-closed contacts T7–T8 on the normal direction side, the normal-open contacts T13–T14 (now closed) on the reverse direction side, and the normally-closed contact Ic62 of the third stage speed reverse direction contact MC6. In the same way, when the third stage speed reverse direction push button is depressed, since the normally-open contacts T15–T16 on the reverse direction side are turned on, the sixth contact MC6 can be energized by way of the power source PS, the normally-closed contacts T7–T8 on the normal direction side, and the normal-open contacts T15–T16 (now closed) on the reverse direction side.

In the above-mentioned case, as shown in FIG. 7, the normally-open contact terminal T1 and the normally-closed contract terminal T17 can be connected easily by use of a connection plate 15*a*, because the two terminals T1 and T17 are arranged side by side. In the prior art push button, since the movable bodies are arranged in the casing and the fixed bodies are arranged on the base, separately, it has been necessary to use an extension wire to connect these terminals. In the present invention, however, since the movable bodies are moved only in the horizontal direction, it is possible to simplify the electrical interlock operation through the normally-closed contacts.

With reference to FIG. 4, the case where the push button switch according to the present invention is applied to the switch for driving a motor at three stage speeds in both the normal and reverse directions will be explained. The arrangements of the respective movable contacts are now explained. In FIG. 4, the inside of the casing 1 is divided into the right side (e.g., normal direction side) and the left side (e.g., reverse direction side) by the two opposing projection walls 11. On the right half (the normal direction) side, the lower left side is the first stage speed normally-open contacts 18*a* and 19*a* (only the movable contact numeral 18*a* is shown but the fixed contact numeral 19*a* is omitted); the lower right sides is the second stage speed normally-open contact 18*b* and 19*b*. The upper right side is the third stage speed normally-open contact 18*c* and 19*c*; and the upper left sides is the electrical interlock normally-closed contact 18*d* and 19*d*.

Further, on the left half (the reverse direction) side, the upper right side is the first stage speed normally-open contact 18*a* and 19*a*. The upper left side is the second stage speed normally-open contact 18*b* and 19*a;* the lower left side is the third stage speed normally-open contact 18*c* and 19*c;* and the lower right side is the electrical interlock normally-closed contact 18*d* and 19*d*. In the construction as described above, the second and third stage speed normal open contacts 18*b* and 18*c* are both arranged in the lateral direction on both the right half of the normal direction contacts and the left half of the reverse direction contacts.

Figure 8A:
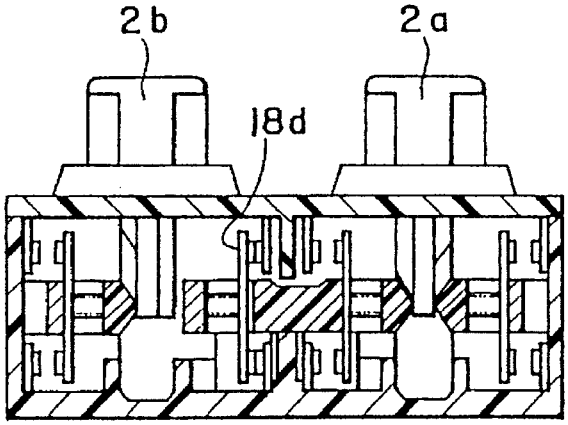
FIGS. 8(A) to 8(D) are cross-sectional views taken along section lines 8A—8A, 8B—8B, 8C—8C and 8D—8D of FIG. 4, showing the push button switch according to the present invention, for assistance in explaining the movements of the normal open switches at the first to third stages (strokes)
Figure 8B:
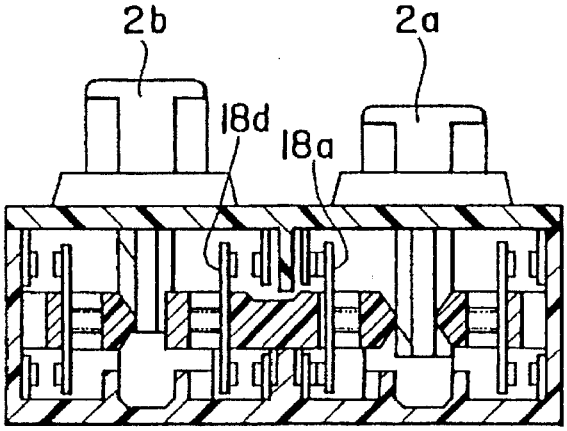
Figure 8C:
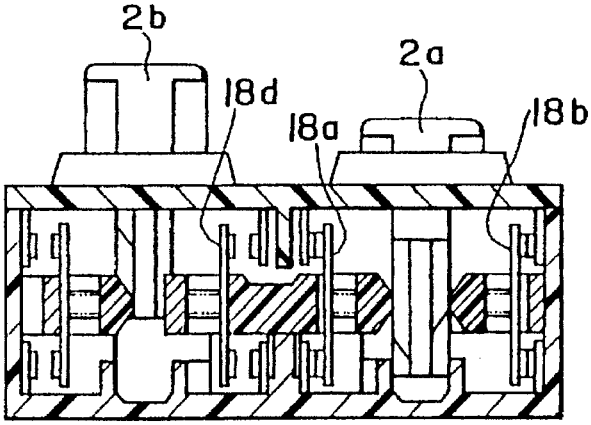
Figure 8D:
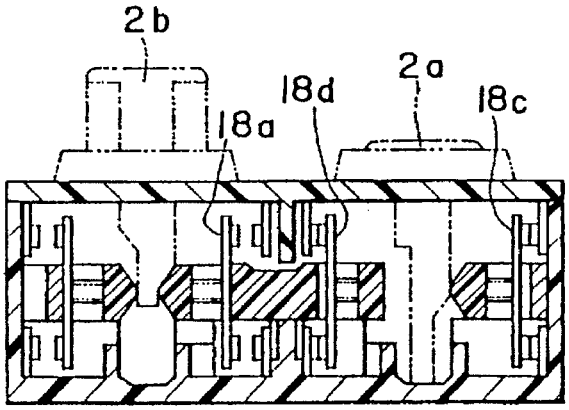

With reference to FIGS. 8(A) to 8(D), the open-closed conditions of the respective movable contacts when The normal direction push button 2*a* is depressed deeply in sequence will be explained. When the push button 2*a* is not depressed as shown in FIG. 8(A), the first-, second- and third-stage speed normal direction normally-open contacts 18*a,* 18*b* and 18*c* are all turned off. On the other hand, only the interlock normally-closed contact 18*d* is turned on to interlock the reverse direction contact circuit. When the push button 2*a* is depressed to a first depth as shown in FIG. 8(B), only the first stage speed normal direction normally-open contact 18*a* is turned on (by the downward sloping portion 2*i* shown in FIG. 5). The second- and third stage speed normal direction normally-open contacts 18*b* and 18*c* are turned off; and the interlock normally-closed contact 18*d* is turned off. When the push button 2*a* is further depressed to a second depth as shown in FIG. 8(C), the second stage speed normal direction normally-open contact 18*b* is additionally turned on (by the downward sloping portion 2*h* shown in FIG. 5); and when the push button 2*a* is further depressed to a third depth as shown in FIG. 8(D), the third speed normal direction normally-open contact 18*c* (not shown in FIG. 8(D)) is additionally turned on (by the downward sloping portion 2*d* shown in FIG. 5). As described above, since the movable bodies 10 are moved in the direction perpendicular to the movement direction of the push button, it is possible to realize a multistage operation by utilizing a narrow space effectively.

Figure 9A:
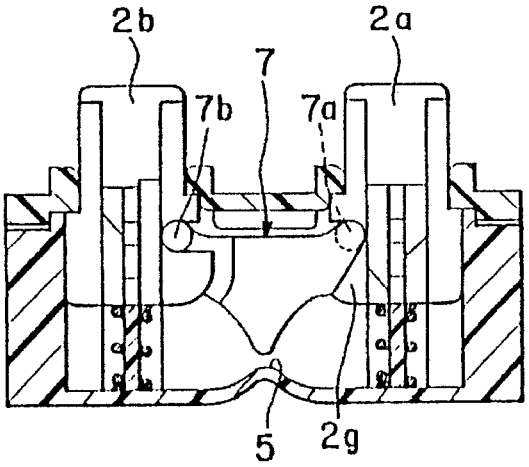
FIGS. 9(A), 9(C) and 9(E) are cross-sectional views for assistance in explaining the movement of the interlock plate of the push button switch according to the present invention at different open-closed conditions.
Figure 9B:
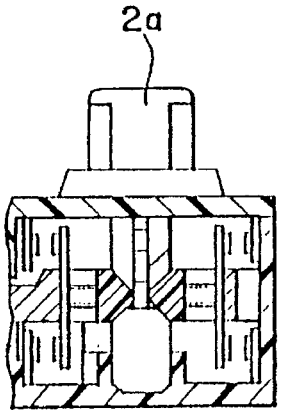
FIGS. 9(B), 9(D) and 9(F) are cross-sectional views for assistance in explaining the movement of the movable contacts of the push button switch according to the present invention in correspondence to the interlock plate movement shown in FIGS. 9(A), (C) and 9(E), respectively.
Figure 9C:
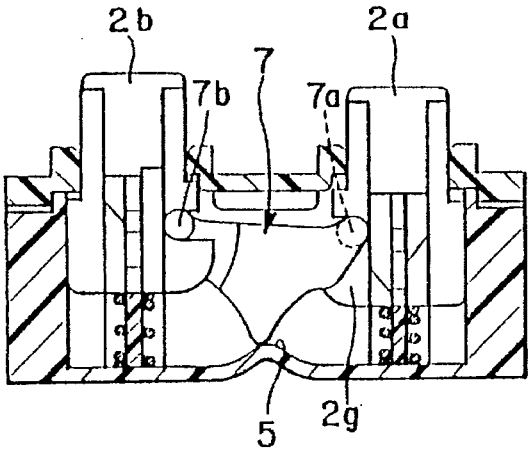
Figure 9D:
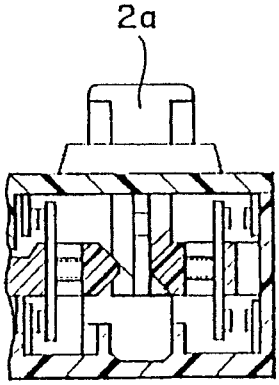
Figure 9E:
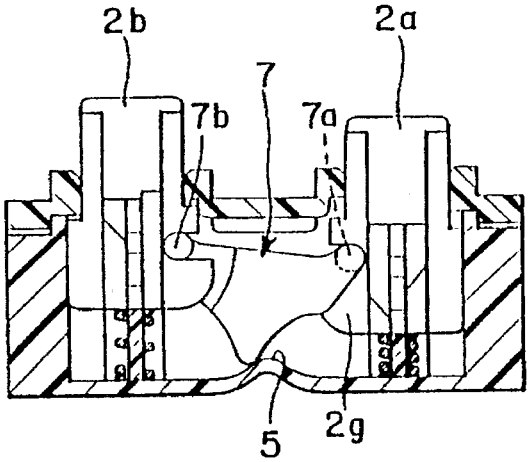
Figure 9F:
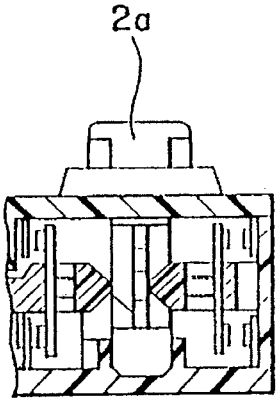

With reference to FIGS. 9(A) to 9(F), the movement of the interlock plate 7 and the movable normally-open contacts obtained when the push button 2*a* is depressed will be explained, in which FIGS. 9(A), 9(C) and 9(E) show the movement of the interlock plate 7 and FIGS. 9(B), 9(D) and 9(F) show the movement of the normally-open contacts (because the interlock plate 7 and the movable normally-open contacts are not arranged on the same plane).

FIG. 9(A) shows the state where the push button 2*a* is not depressed. FIG. 9(C) shows the state where the left side push button 2*b* is depressed slightly and the right side push button 2*a* is pushed so that the movable contact 18*a* is brought into contact with the fixed contact 19*a*. Under these conditions, the lower side portion of the interlock plate 7 is in contact with the left side of the lower projection 5 (to provide an interlock effect). FIG. 9(E) shows the state where the right side push button 2*a* is further depressed to further shift the projection portion 5 of the interlock plate 5 under the condition that the normally-open contacts 18*a* and 19*a* are kept in contact with each other. In this case, the axle portion 7*a* of the interlock plate 7 slides in the engaging portion 2*g* of the push button 2*a* in the horizontal direction. Since the fulcrum of the interlock plate 7 is not fixed, it is possible to construct the multistage push button switch provided with a multistage actuation interlock function in a narrow space.

What is claimed is:

1. A push button switch provided with a multistage actuation interlock function, which comprises:

a casing having an upper lid and a base portion;

a pair of push buttons arranged side by side passing through said upper lid of said casing;

a plurality of movable bodies arranged movably in a direction perpendicular to a depression direction of said push buttons into said casing;

a plurality of movable contacts arranged on said base portion of said casing in confronting positional relationship with respect to said movable contacts, wherein:

whenever each of said push buttons is depressed in said depression direction at multistage strokes, each of said movable bodies is shifted in said direction perpendicular to said depression direction to bring each of said movable contacts into contact with each of said fixed contacts, respectively, in sequence; and an interlock mechanism interposed between and operatively associated with said pair of push buttons within said casing.

2. The push button switch provided with a multistage actuation interlock function of claim 1, wherein said interlock mechanism is an interlock plate having:

a pair of axle portions formed on upper right and left sides of the interlock plate and extending in two opposite directions, respectively perpendicular to the interlock plate, for engaging with a lower portion of each of said push buttons; and a convex curved portion formed symmetrically on a lower middle portion of the interlock plate, for engaging with or disengaging from a triangular projection formed on the base portion of said casing.

3. The push button switch provided with a multistage actuation interlock function of claim 1, wherein each of said push buttons includes:

a flat plate extending perpendicular to an axial depression direction of said push button on each side of said push button; and means formed on both sides of said flat plate, for pushing each of said movable bodies in said direction perpendicular to said depression direction, respectively at each of said multistage strokes.

4. the push button switch provided with a multistage actuation interlock function of claim 1, wherein a set of said movable bodies arranged on one of right and left side blocks of said casing are moved in response to depression of any one of said push buttons.

* * * * *